US010518529B2

(12) United States Patent
Sugai

(10) Patent No.: US 10,518,529 B2
(45) Date of Patent: Dec. 31, 2019

(54) LIQUID DISCHARGE DEVICE

(71) Applicant: SEIKO EPSON CORPORATION, Tokyo (JP)

(72) Inventor: Keigo Sugai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/113,549

(22) Filed: Aug. 27, 2018

(65) Prior Publication Data

US 2019/0061348 A1 Feb. 28, 2019

(30) Foreign Application Priority Data

Aug. 29, 2017 (JP) ..... 2017-164204

(51) Int. Cl.
*B41J 2/045* (2006.01)
*B41J 2/14* (2006.01)

(52) U.S. Cl.
CPC ..... *B41J 2/04525* (2013.01); *B41J 2/04581* (2013.01); *B41J 2/04588* (2013.01); *B41J 2/14274* (2013.01); *B41J 2/14201* (2013.01)

(58) Field of Classification Search
CPC ..... B41J 2/04525; B41J 2/04581; B41J 2/14274; B41J 2/04588; B41J 2/14201
See application file for complete search history.

(56) References Cited

U.S. PATENT DOCUMENTS

2007/0279460 A1 12/2007 Yokoyama et al.
2010/0123757 A1* 5/2010 Okazawa ..... B41J 2/14274 347/54
2011/0169897 A1* 7/2011 Yokoyama ..... B41J 2/055 347/70

FOREIGN PATENT DOCUMENTS

JP 2007-320042 A 12/2007
JP 2011-131571 A 7/2011

* cited by examiner

*Primary Examiner* — Geoffrey S Mruk
(74) *Attorney, Agent, or Firm* — Workman Nydegger

(57) ABSTRACT

The liquid discharge device includes a plurality of volume changing portions and at least one blocking portion. The plurality of volume changing portions are in combination with a plurality of pressure chambers which communicate with nozzles for discharging a liquid and which have inlets through which the liquid flows into the plurality of pressure chambers. The at least one blocking portion blocks communication at the inlets. The plurality of volume changing portions are arranged in a plurality of rows spaced from one another. In a direction along the plurality of rows, the plurality of rows of volume changing portions are staggered from one another. The liquid is discharged from the nozzles by using the plurality of volume changing portions in a state in which the inlets are blocked by the at least one blocking portion.

6 Claims, 15 Drawing Sheets

LIQUID DISCHARGE DEVICE

BACKGROUND

1. Technical Field

The present invention relates to a liquid discharge device.

2. Related Art

JP-A-2007-320042 discloses a liquid discharge device that includes a plurality of combinations of nozzles for discharging droplets and pressure chambers in communication with the nozzles. The plurality of nozzles are arranged in a row. The plurality of pressure chambers are also arranged in a row.

Since the pressure chambers are arranged in a row in the liquid discharge device disclosed in JP-A-2007-320042, the pitch of the nozzles adjacent to the pressure chambers are determined in accordance with the volume of the pressure chambers. An increase in density of the nozzles is not considered. Accordingly, techniques that increase the density of the nozzles have been desired.

SUMMARY

An advantage of an aspect of the invention is to at least partly address the above-described problem. This can be achieved by the following form.

1. According to a form of an aspect of the invention, a liquid discharge device is provided. The liquid discharge device includes a plurality of volume changing portions and at least one blocking portion. The plurality of volume changing portions are in combination with a plurality of pressure chambers which communicate with nozzles for discharging a liquid and which have inlets through which the liquid flows into the plurality of pressure chambers. The plurality of volume changing portions change volumes of the plurality of pressure chambers so as to apply pressure to insides of the plurality of pressure chambers, thereby discharging the liquid from the nozzles. The at least one blocking portion blocks communication at the inlets. The plurality of volume changing portions are arranged in a plurality of rows spaced from one another. In a direction along the plurality of rows, the plurality of rows of volume changing portions are staggered from one another. The liquid is discharged from the nozzles by using the plurality of volume changing portions in a state in which the inlets are blocked by the at least one blocking portion. With the liquid discharge device in such a form, the rows of the volume changing portions are staggered from one another. This can improve the density of the volume changing portions per unit area. Accordingly, the density of the nozzles can be improved. Also with the liquid discharge device in such a form, the pressure in the pressure chambers applied by the volume changing portions can be efficiently transmitted to the liquid.

2. It is preferable that, in the liquid discharge device in the above-described form, the nozzles be arranged in a single row. With such a liquid discharge device, ease of controlling the positions of the liquid discharged from the nozzles is increased.

3. It is preferable that, in the liquid discharge device in the above-described form, the at least one blocking portion include a plurality of separate blocking portions that are independently movable. In this case, the plurality of blocking portions are each able to block one or more inlets. With the liquid discharge device in such a form, each of the separate blocking portions can be independently controlled. Thus, the control can be performed in more flexible manner.

4. It is preferable that each of the pressure chambers together with a corresponding one of the nozzles that is in communication with the pressure chamber have an equal volume in the state in which the inlets are blocked by the at least one blocking portion. With the liquid discharge device in such a form, variation in the amount of the liquid discharged from the nozzles among the nozzles can be suppressed.

5. It is preferable that a flow resistance from each of the inlets to a corresponding one of the nozzles that is in communication with a corresponding one of the pressure chamber having the inlet be equal. With the liquid discharge device in such a form, the differences in time duration required for discharge and discharge amount between the nozzles can be suppressed.

An aspect of the invention can be achieved in any of various forms other than the above-described form as the liquid discharge device. For example, the aspect of the invention can be achieved in the form of, for example, a method of discharging a liquid performed by the liquid discharge device or a computer program that controls the liquid discharge device and a non-transitory tangible recording medium in which the computer program is recorded.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A1. Structure of a Liquid Discharge Device

Figure 1:
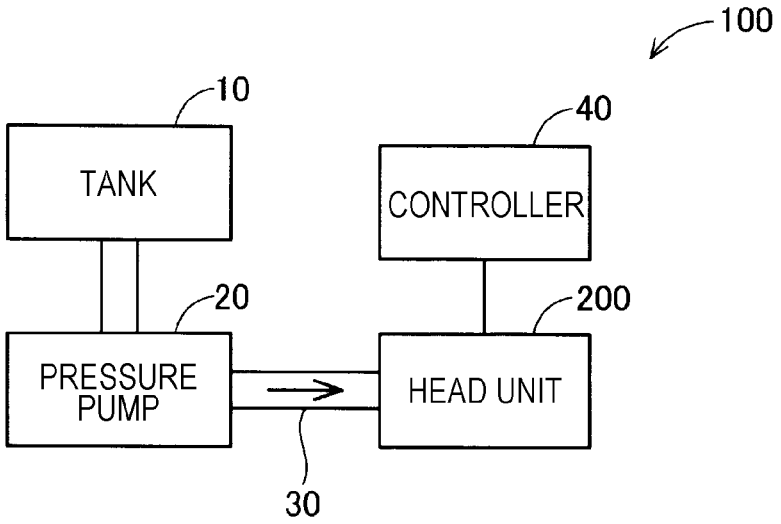
FIG. 1 illustrates an outline structure of a liquid discharge device according to a first embodiment of the invention.

FIG. 1 illustrates an outline structure of a liquid discharge device 100 according to a first embodiment of the invention. The liquid discharge device 100 includes a tank 10, a pressure pump 20, a supply channel 30, a head unit 200, and a controller 40. According to the present embodiment, the liquid discharge device 100 discharges a liquid including a solute and a solvent.

The tank 10 contains a liquid. For example, the liquid can be exemplified by ink having a specified viscosity. The specified viscosity can be, for example, from 50 to 40,000 mPa·s at room temperature (25 degrees centigrade). The liquid in the tank 10 is supplied by using the pressure pump 20 to the head unit 200 through the supply channel 30. The pressure pump 20 applies a pressure of, for example, 10 kPa to 10 MPa to the liquid. The liquid supplied to the head unit 200 is to be discharged from the head unit 200. Operation of the head unit 200 is controlled by the controller 40.

The controller 40 is configured as a computer that includes a central processing unit (CPU) and memory. Various processes are performed by executing a control program stored in the memory. The control program may be recorded in any of various non-transitory tangible recording media.

Figure 2:
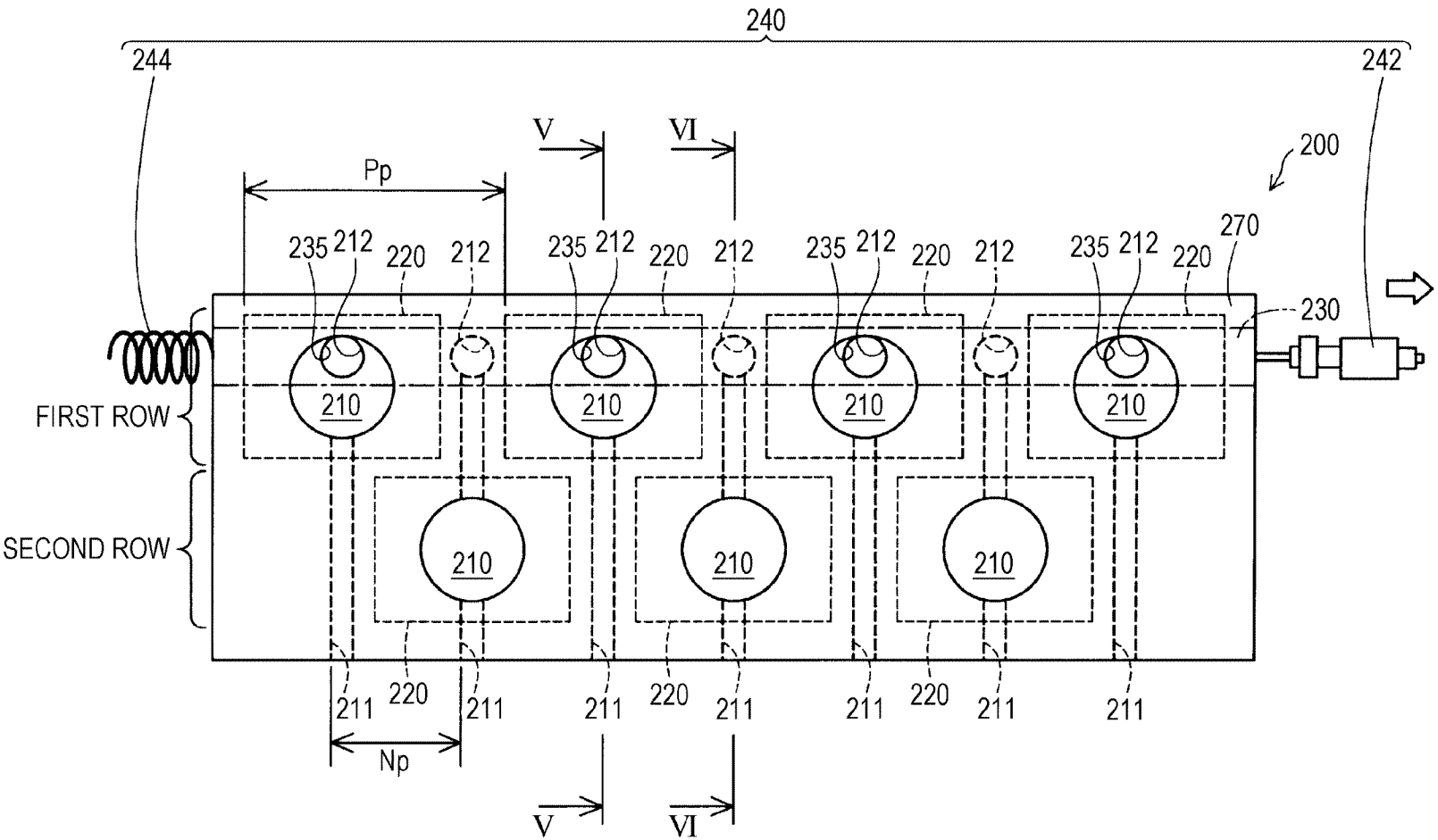
FIG. 2 illustrates an outline structure of a head unit.

FIG. 2 illustrates an outline structure of the head unit 200. The head unit 200 includes nozzles 211, pressure chambers 210, volume changing portions 220, a blocking portion 230, and an actuator 240. The head unit 200 includes a plurality of combinations of nozzles 211, respective pressure chambers 210, and respective volume changing portions 220. According to the present embodiment, seven combinations of the nozzles 211, the respective pressure chambers 210, and the respective volume changing portions 220 are provided.

The liquid is supplied to the pressure chambers 210. The pressure chambers 210 each communicate with a corresponding one of the nozzles 211 through which the liquid is discharged to the outside.

Figure 3:
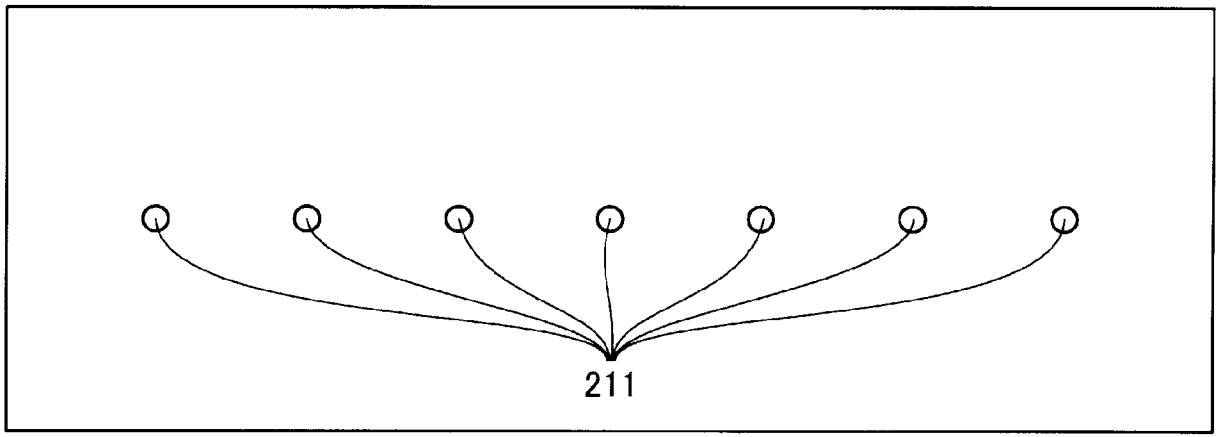
FIG. 3 is a schematic view of nozzles when seen from below in the direction of gravity.

FIG. 3 is a schematic view of the nozzles 211 when seen from below in the direction of gravity. According to the present embodiment, the nozzles 211 are arranged in a row when seen from below in the gravity direction.

As illustrated in FIG. 2, the pressure chambers 210 each have an inlet 212 through which the liquid flows into the pressure chamber 210. The liquid is supplied from the supply channel 30 to the pressure chamber 210 through the inlet 212. According to the present embodiment, a plurality of the inlets 212 are arranged in a row. Furthermore, an upper end of each of the inlets 212 is in contact with an upper end of a corresponding one of the pressure chambers 210. In this way, the liquid is reliably supplied to the upper end of the pressure chamber 210. In addition, the position in the pressure chamber 210 where the inlet 212 is disposed is farthest from the corresponding nozzle 211. This reduces the likelihood of bubbles that have entered through the nozzle 211 reaching the inlet 212.

The blocking portion 230 blocks the inlets 212. The blocking portion 230 has communication holes 235 which allow communication with the inlets 212 of the pressure chambers 210. According to the present embodiment, the blocking portion 230 is in contact with the actuator 240. With the actuator 240, the blocking portion 230 is slidable relative to the pressure chambers 210. According to the present embodiment, the actuator 240 includes a pushing mechanism 242 (on the right-hand side of FIG. 2) and a spring 244 (on the left-hand side of FIG. 2). The blocking portion 230 slides relative to the pressure chambers 210 in the horizontal direction of the FIG. 2. The pushing mechanism 242 is driven by the controller 40.

Figure 4:
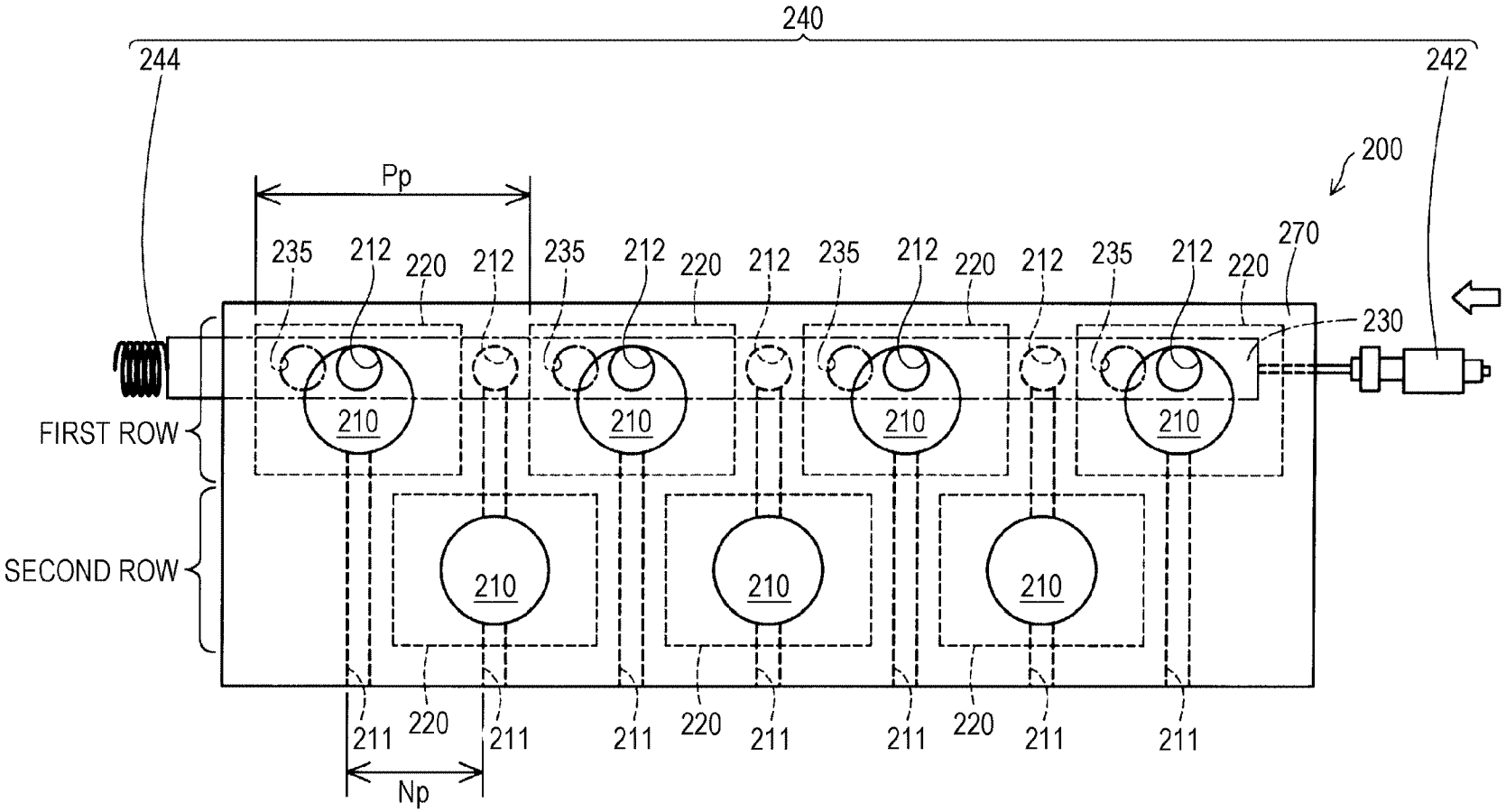
FIG. 4 illustrates a state in which communication between pressure chambers and a supply channel is blocked.

FIG. 2 illustrates a state in which the pressure chambers 210 communicate with the supply channel 30. FIG. 4 illustrates a state in which communication between the pressure chambers 210 and the supply channel 30 is blocked. Here, the term "communicate" means "connected so as to allow a flow of a fluid".

Referring to FIG. 2, control performed on the pushing mechanism 242 by the controller 40 causes the pushing mechanism 242 to contract, thereby the spring 244 extends and the blocking portion 230 is moved rightward in FIG. 2 relative to the inlets 212 of the pressure chambers 210. Thus, the communication holes 235 of the blocking portion 230 are positioned so as to be superposed on the inlets 212 of the pressure chambers 210 when seen from the pressure chamber 210 side. This allows the pressure chambers 210 to communicate with the supply channel 30.

Referring to FIG. 4, control performed on the pushing mechanism 242 by the controller 40 causes the pushing mechanism 242 to extend toward the blocking portion 230, thereby the spring 244 contracts and the blocking portion 230 is moved leftward in FIG. 4 relative to the inlets 212 of the pressure chambers 210. Thus, the communication holes 235 of the blocking portion 230 are positioned so as not to be superposed on the inlets 212 of the pressure chambers 210 when seen from the pressure chamber 210 side. This blocks liquid communication through the inlets 212, and accordingly, communication between the pressure chambers 210 and the supply channel 30 is blocked. According to the present embodiment, the controller 40 causes the liquid to be discharged from the nozzle 211 in a state in which communication through the inlets 212 is blocked by the blocking portion 230.

As illustrated in FIG. 2, one wall of each of the pressure chambers 210 is formed by a corresponding one of the volume changing portions 220. The volume changing portion 220 changes the volume of the pressure chamber 210 so as to apply a pressure to the inside of the pressure chamber 210, so that the liquid is discharged from the nozzle 211. According to the present embodiment, the volume changing portions 220 each include a vibrating plate and a piezoactuator. The volume changing portion 220 is controlled by the controller 40. The controller 40 controls the piezoactuator of the volume changing portion 220, thereby causing the vibrating plate to be displaced toward the inside the pressure chamber 210. Thus, the volume of the pressure chamber 210 is reduced, and accordingly, the pressure is increased in the pressure chamber 210. Then, when the pressure inside the pressure chamber 210 exceeds a meniscus withstand pressure of the liquid in the nozzle 211, a droplet is discharged from the nozzle 211.

According to the present embodiment, seven of the volume changing portions 220 are provided. Rows of the volume changing portions 220 are staggered on a single plane. That is, the volume changing portions 220 are arranged in a plurality of rows spaced from one another, and the rows of the volume changing portions 220 are staggered from one another in the direction along the rows. According to the present embodiment, the volume changing portions 220 are arranged in two rows extending in the horizontal direction of FIG. 2. The upper row in FIG. 2 is referred to as "first row" and the lower row in FIG. 2 is referred to as "second row". According to the present embodiment, four of the volume changing portions 220 are provided in the first row, and three of the volume changing portions 220 are provided in the second row. Furthermore, a plurality of the volume changing portions 220 are arranged in a plane that is parallel to the direction of the nozzle rows and also parallel to a direction in which droplets are discharged from the nozzles 211. The direction of each of the plurality of the rows of the volume changing portions 220 is parallel to the nozzle row direction.

Figure 5:
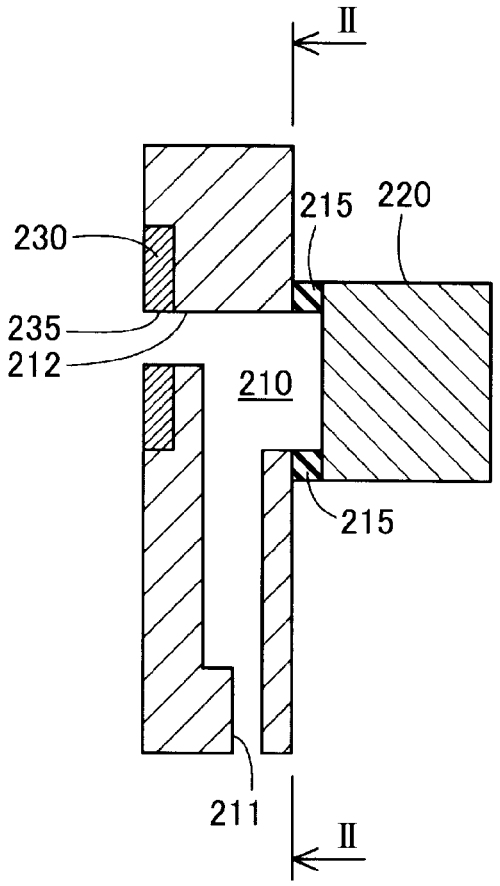
FIG. 5 is a sectional view taken along line V-V of FIG. 2.

FIG. 5 is a sectional view taken along line V-V of FIG. 2, illustrating one of the pressure chambers 210 corresponding to one of the volume changing portions 220 in the first row. FIG. 2 is a sectional view taken along line II-II of FIG. 5. In the gravity direction (vertical direction in FIGS. 2 and 5), the volume changing portions 220 in the first row are positioned so as to be superposed on the inlets 212 of the respective pressure chambers 210. From the viewpoint of suppressing leakage of the liquid, for each of the pressure chambers 210, sealing members 215 are provided between the volume changing portion 220 that forms the one wall of the pressure chamber 210 and members that form other walls of the pressure chamber 210.

Figure 6:
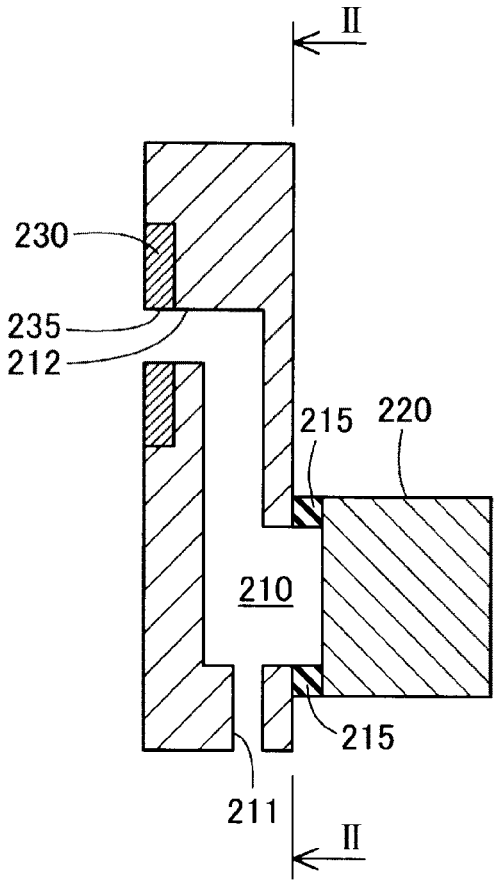
FIG. 6 is a sectional view taken along line VI-VI of FIG. 2.

FIG. 6 is a sectional view taken along line VI-VI of FIG. 2, illustrating one of the pressure chambers 210 corresponding to one of the volume changing portions 220 in the second row. FIG. 2 is a sectional view taken along line II-II of FIG. 6. In the gravity direction, the volume changing portions 220 in the second row are positioned so as not to be superposed on the inlets 212 of the respective pressure chambers 210. The volume changing portions 220 in the second row are disposed below the inlets 212 of the respective pressure chambers 210 in the gravity direction. According to the present embodiment, in each of combinations of the pressure chambers 210 and the nozzles 211, the pressure chamber 210 together with the nozzles 211 has an equal volume in the state in which the inlets 212 are blocked by the blocking portion 230.

As has been described, in the liquid discharge device 100 according to the first embodiment, as illustrated in FIG. 2, the volume changing portions 220 are arranged in a plurality of rows spaced from one another, and the rows of the volume changing portions 220 are staggered from one another in the direction along the rows. Accordingly, a pitch Pp of the volume changing portions 220 can be larger than a pitch Np of the nozzles 211. As a result, the density of the nozzles 211 can be increased.

Furthermore, according to the first embodiment, the volume changing portions 220 are arranged in a plurality of rows spaced from one another, and the rows of the volume changing portions 220 are staggered from one another in the direction along the rows. Thus, the size of the volume changing portions 220 can be increased compared to the case where the volume changing portions 220 are arranged parallel to one another. That is, according to the first embodiment, large piezoactuators can be used. As a result, forces applied to the pressure chambers 210 by the volume changing portions 220 can be increased. Accordingly, the viscosity of the liquid to be discharged from the nozzles 211 can be increased.

Furthermore, in the liquid discharge device 100 according to the first embodiment, the plurality of nozzles 211 are arranged in a single row. This increases ease of controlling the positions of the liquid discharged from the nozzles 211.

Furthermore, according to the present embodiment, in each of the combinations of the pressure chambers 210 and the nozzles 211, the pressure chamber 210 together with the nozzles 211 has an equal volume in the state in which the inlets 212 are blocked by the blocking portion 230. This can suppress variation in the amount of the liquid discharged from the nozzles 211 among the nozzles 211. In particular, when the liquid having a viscosity of 200 mPa·s or higher at room temperature (25 degrees centigrade) is used, that is, when the viscosity of the liquid is high, a movement of the liquid due to inertia becomes relatively small and the viscous drag becomes relatively large. As a result, the amount by which the volume of the pressure chambers 210 has been changed tends to approximate the discharge amount from the nozzles 211. Thus, in the case where the viscosity of the liquid is high, variation in the amount of the liquid discharged from the nozzles 211 among the nozzles 211 can be more effectively suppressed when each of the pressure chambers 210 together with a corresponding one of the nozzles 211 has an equal volume in the state in which the inlets 212 are blocked by the blocking portion 230.

Furthermore, in the liquid discharge device 100 according to the first embodiment, the plurality of inlets 212 are arranged in a single row. This can reduce the width of the blocking portion 230 in the vertical direction.

Furthermore, in the liquid discharge device 100 according to the first embodiment, the liquid is discharged from the nozzles 211 by using the volume changing portions 220 in the state in which communication through the inlets 212 is blocked by the blocking portion 230. In this way, the pressure applied to the pressure chambers 210 by the volume changing portions 220 can be efficiently transmitted to the liquid.

According to the first embodiment, since the positions of the volume changing portions 220 in the first raw are different from the positions of the volume changing portions 220 in the second row in the gravity direction, there is the difference in distance between the volume changing portions 220 and the nozzles 211. Thus, even when the volume changing portions 220 in the first row and the volume changing portions 220 in the second row apply to the pressure chambers 210 forces of the same amount at the same timing, there are the difference in timing at which the liquid is ejected from the nozzles 211 and the difference in amount of the liquid ejected from the nozzles 211. According to the present embodiment, the amount of the forces applied to the pressure chambers 210 by the volume changing portions 220 and the timing at which the forces are applied to the pressure chambers 210 by the volume changing portions 220 in the first row and the amount of the forces applied to the pressure chambers 210 by the volume changing portions 220 and the timing at which the forces are applied to the pressure chambers 210 by the volume changing portions 220 in the second row are adjusted as described below so as to adjust the ejecting amount and the ejecting timing.

A2. Method of Discharging the Liquid

Figure 7:
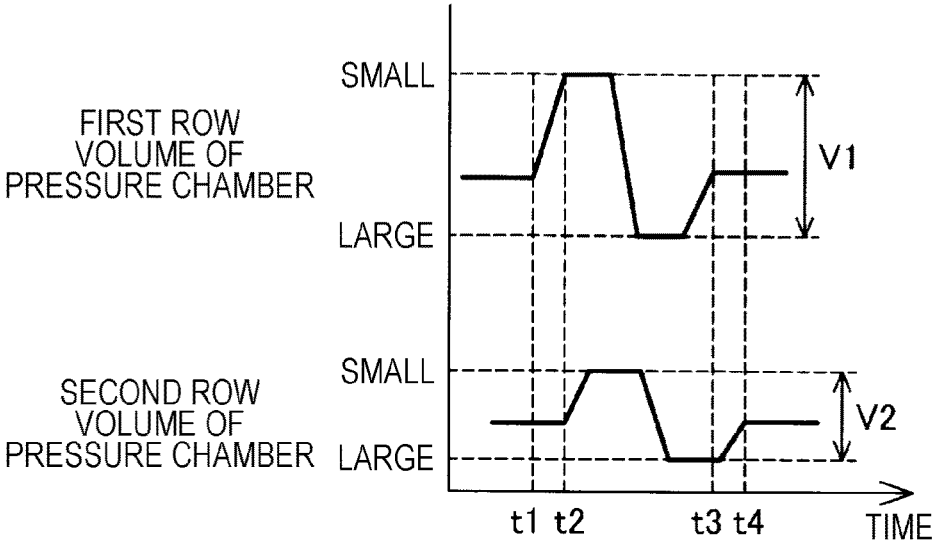
FIG. 7 is a timing chart illustrating processing in a method of discharging the liquid.

FIG. 7 is a timing chart illustrating processing in a method of discharging the liquid performed by the controller 40. In FIG. 7, the horizontal axis represents elapsed time and the vertical axis represents changes in volume of the pressure chambers 210. FIG. 7 illustrates discharge control processing for discharge of the liquid at a time. Thus, when the liquid is continuously discharged, the controller 40 repeatedly continuously performs the discharge control processing.

First, in a period of time from time t1 to time t3 illustrated in FIG. 7, the controller 40 first controls the volume changing portions 220 in the first row so as to quickly reduce the volume of the corresponding pressure chambers 210. This causes the liquid to be discharged from the nozzles 211. Then, the controller 40 performs a process so as to slightly increase the volume of the pressure chambers 210 in the first row by using the corresponding volume changing portions 220. This allows droplets discharged from the nozzles 211 to be separated from the liquid remaining in the nozzles 211.

Furthermore, the controller 40 controls the volume changing portions 220 in the second row in a period of time from time t2 after the time t1 to time t4 after the time t3. Specifically, the controller 40 first controls the volume changing portions 220 in the second row so as to quickly reduce the volume of the corresponding pressure chambers 210. This causes the liquid to be discharged from the nozzles 211. Then, the controller 40 performs a process so as to slightly increase the volume of the pressure chambers 210 in the second row by using the corresponding volume changing portions 220. In each of the rows, the volume changing portions 220 are controlled by the controller 40 in the same manner according to the first embodiment. However, the control may vary on a volume-changing-portion-220-by-volume-changing-portion-220 basis.

Here, as illustrated in FIG. 7, during the discharge control processing for discharge of the liquid at a time, a volume changing amount V1 of the pressure chambers 210 corresponding to the volume changing portions 220 in the first row is larger than a volume changing amount V2 of the pressure chambers 210 corresponding to the volume changing portions 220 in the second row.

In general, as the distance between the volume changing portions 220 and the nozzles 211 increases, energy that is applied to the pressure chambers 210 by the volume changing portions 220 and that reaches the nozzles 211 reduces. According to the present embodiment, the volume changing amount V1 of the pressure chambers 210 corresponding to the volume changing portions 220 in the first row is larger than the volume changing amount V2 of the pressure chambers 210 corresponding to the volume changing portions 220 in the second row. This can suppress the difference between the amount of energy that reaches the nozzles 211 corresponding to the volume changing portions 220 in the first row and the amount of energy that reaches the nozzles 211 corresponding to the volume changing portions 220 in the second row.

Furthermore, the liquid discharge control performed by the controller 40 starts earlier on the volume changing portions 220 in the first row than on the volume changing portions 220 in the second row. This can suppress the difference between liquid discharge timing for the nozzles 211 corresponding to the volume changing portions 220 in the first row and liquid discharge timing for the nozzles 211 corresponding to the volume changing portions 220 in the second row.

B. Second Embodiment

Figure 8:
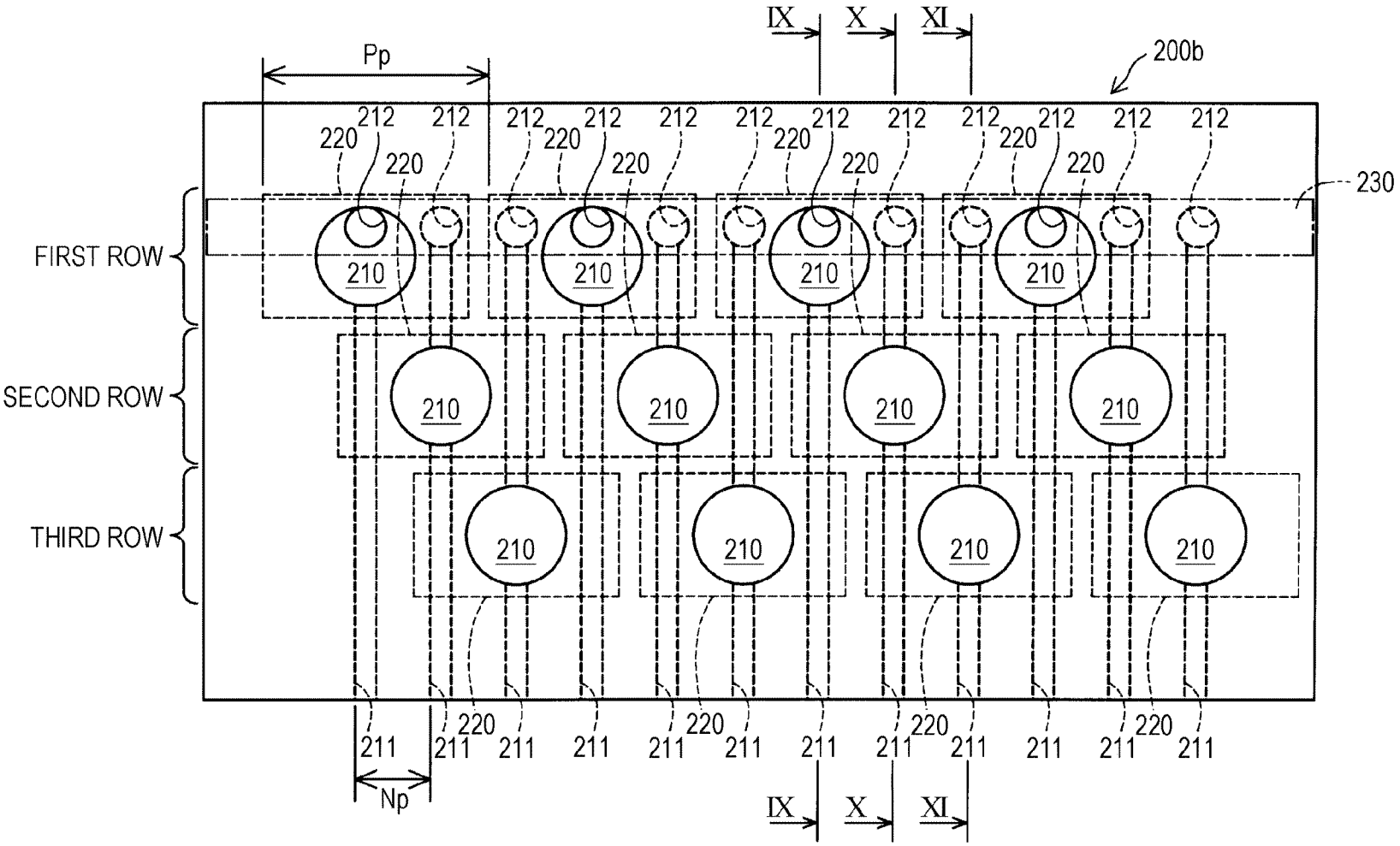
FIG. 8 illustrates an outline structure of a head unit according to a second embodiment.

FIG. 8 illustrates an outline structure of a head unit 200*b* according to a second embodiment. The head unit 200*b* according to the second embodiment includes 12 combinations of the nozzles 211, the respective pressure chambers 210, and the respective volume changing portion 220. According to the second embodiment, the volume changing portions 220 are arranged in three rows extending in the horizontal direction in FIG. 8. The volume changing portions 220 are disposed on a single plane such that the volume changing portions 220 adjacent to each other are not superposed on each other. The actuator 240 that causes the blocking portion 230 to operate is omitted from FIG. 8.

Figure 9:
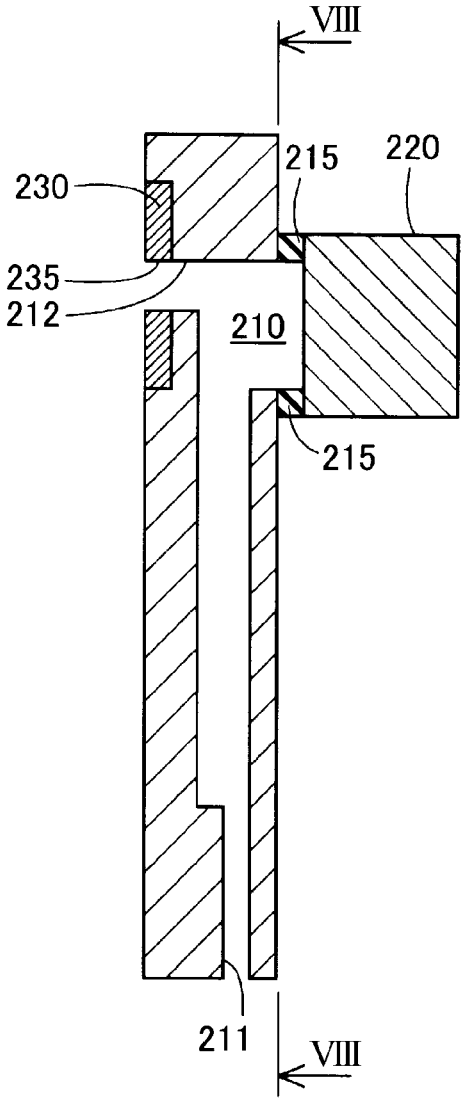
FIG. 9 is a sectional view taken along line IX-IX of FIG. 8.
Figure 10:
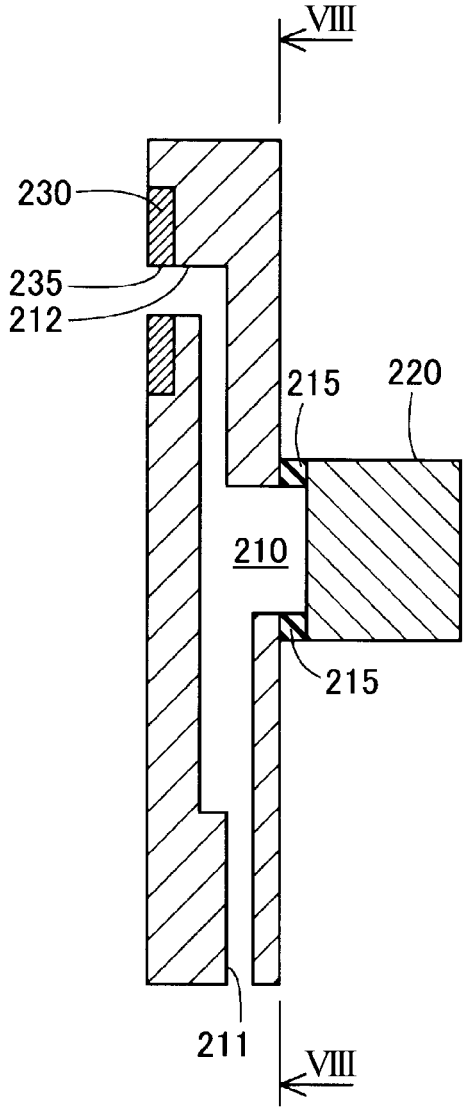
FIG. 10 is a sectional view taken along line X-X of FIG. 8.
Figure 11:
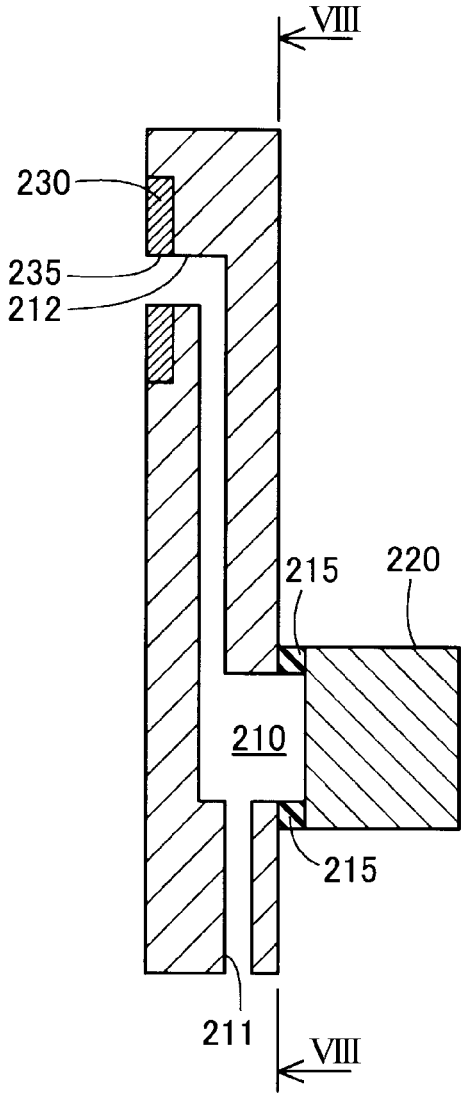
FIG. 11 is a sectional view taken along line XI-XI of FIG. 8.

FIGS. 9, 10, and 11 are sectional views illustrating the respective pressure chambers 210 and regions near the pressure chambers 210. FIG. 9 is a sectional view taken along line IX-IX of FIG. 8, illustrating one of the pressure chambers 210 corresponding to one of the volume changing portions 220 in the first row. In the gravity direction, the volume changing portions 220 in the first row are positioned so as to be superposed on the inlets 212 of the respective pressure chambers 210. FIG. 10 is a sectional view taken along line X-X of FIG. 8, illustrating one of the pressure chambers 210 corresponding to one of the volume changing portions 220 in the second row. The volume changing portions 220 in the second row are disposed below the inlets 212 of the respective pressure chambers 210 in the gravity direction. FIG. 11 is a sectional view taken along line XI-XI of FIG. 8, illustrating one of the pressure chambers 210 corresponding to one of the volume changing portions 220 in a third row. The volume changing portions 220 in the third row are, in the gravity direction, disposed below the volume changing portions 220 in the second row one of which is illustrated in FIG. 10. FIG. 8 is a sectional view taken along line VIII-VIII of FIGS. 9, 10, and 11.

Figure 12:
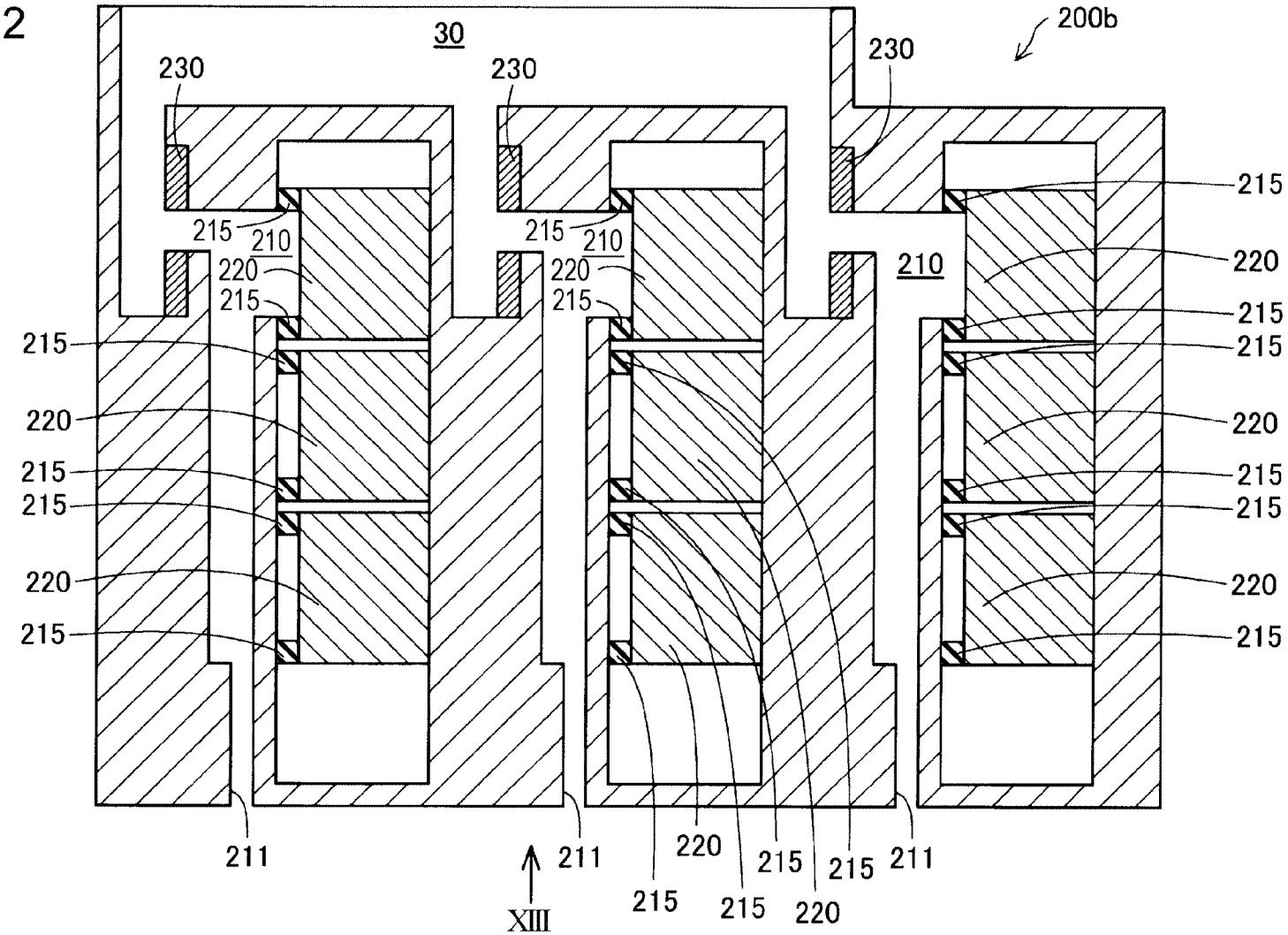
FIG. 12 is a sectional view of the head unit according to the second embodiment.

FIG. 12 is a sectional view of the head unit 200*b* according to the second embodiment. FIG. 12 is a sectional view when seen in a direction that intersects a direction in which the volume changing portions 220 are arranged and also intersects the gravity direction. According to the second embodiment, the volume changing portions 220 are arranged vertically in three rows in the gravity direction and side by side in three rows in the horizontal direction of FIG. 12. The liquid is supplied to each of the pressure chambers 210 from the common supply channel 30.

Figure 13:
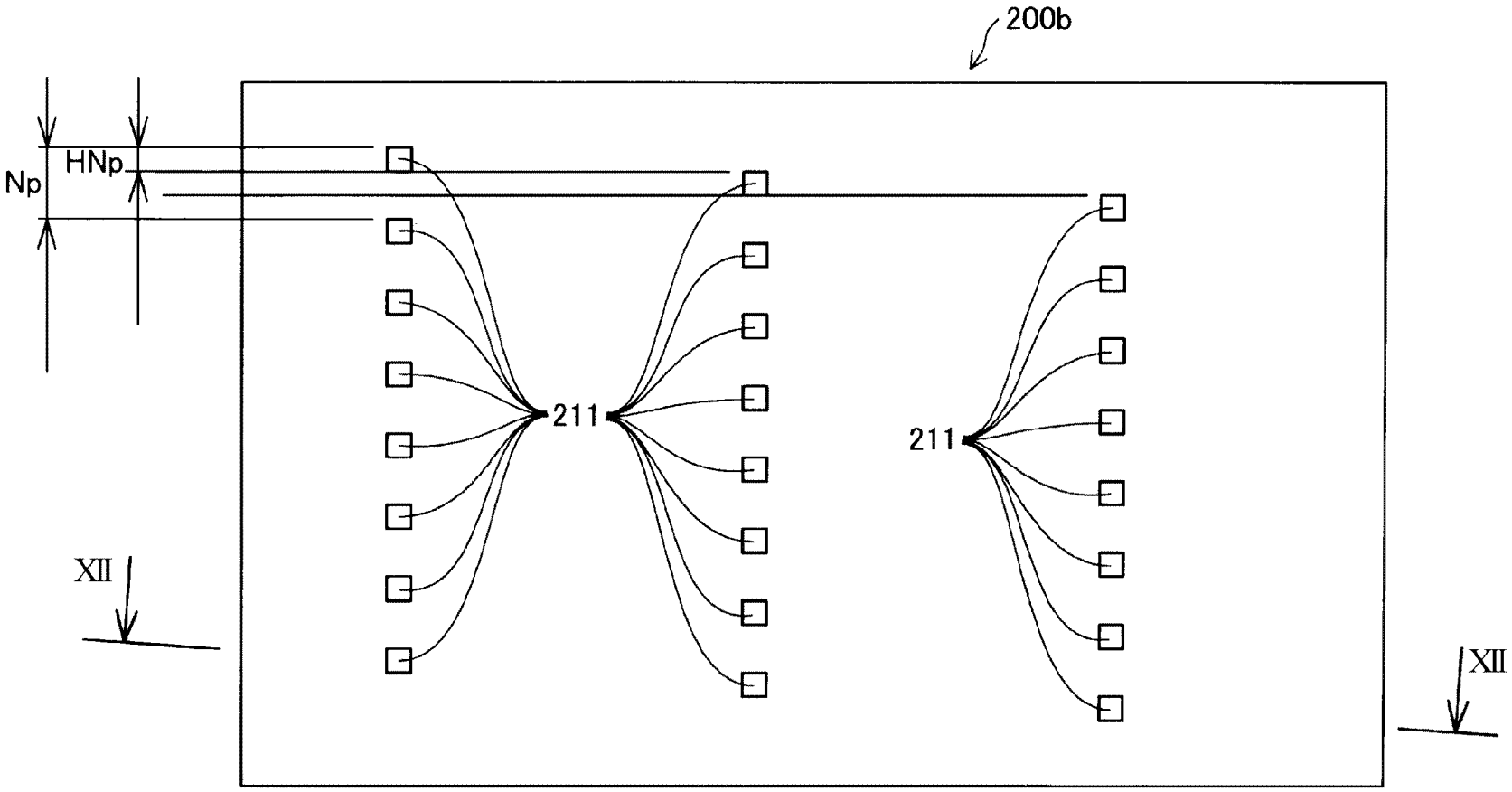
FIG. 13 is a schematic view of the nozzles when seen from below in the gravity direction.

FIG. 13 is a schematic view of the nozzles 211 taken along line XIII-XIII of FIG. 12 when seen from below in the gravity direction. FIG. 12 is a sectional view taken along line XII-XII of FIG. 13. The nozzles 211 corresponding to the respective volume changing portions 220 vertically arranged in FIG. 12 in the gravity direction are, as illustrated in FIG. 13, arranged with a pitch Np in the vertical direction of FIG. 13. Furthermore, the nozzles 211 corresponding to the respective volume changing portions 220 arranged side by side in the horizontal direction of FIG. 12 are arranged in the horizontal direction of FIG. 13 as illustrated in FIG. 13. These nozzles 211 are arranged with a pitch HNp in the vertical direction of FIG. 13. According to the present embodiment, the pitch HNp is about a third of the pitch Np.

In the head unit 200*b* according to the second embodiment, the number of rows in which the volume changing portions 220 are arranged is increased compared to those in the head unit 200 according to the first embodiment. This can further reduce the pitch Np of the nozzles 211 compared to the first embodiment. The volume changing portions 220, which are arranged in two rows according to the first embodiment and in three rows according to the second embodiment, may be arranged in four or more rows.

Furthermore, according to the first embodiment and the second embodiment, the pressure chambers 210 are arranged in the horizontal direction and the volume changing portions 220 are arranged in the horizontal direction. As a result, as illustrated in FIG. 12, the plurality of volume changing portions 220 can be arranged in the gravity direction (vertical direction of FIG. 12) and also in the horizontal direction (horizontal direction of FIG. 12). Consequently, the density of the nozzles 211 can be increased.

C. Third Embodiment

Figure 14:
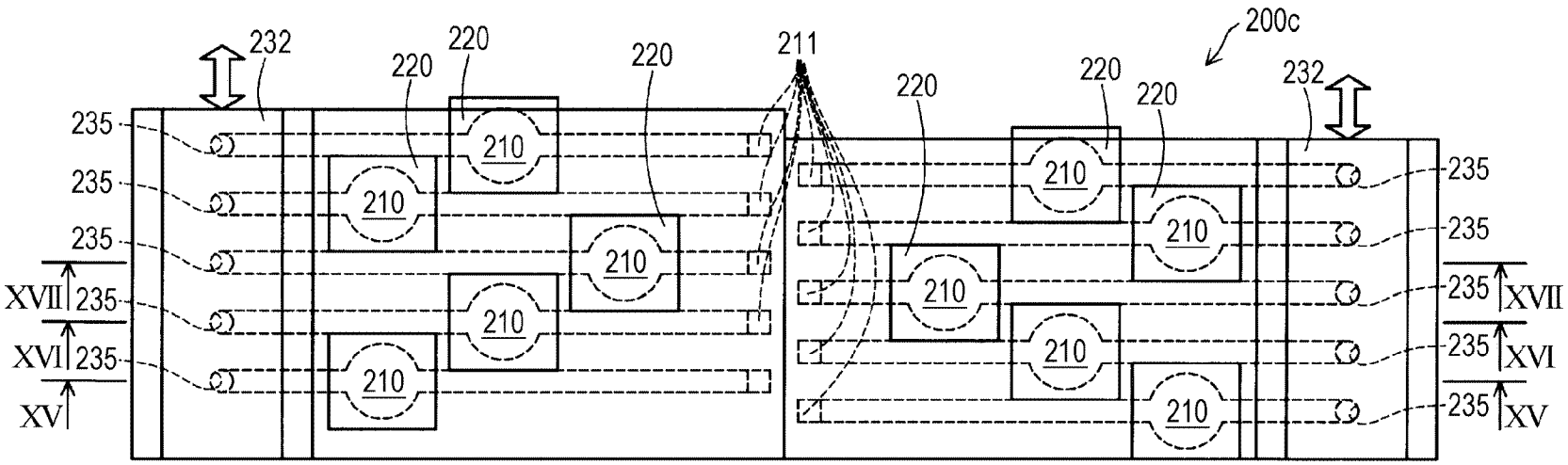
FIG. 14 illustrates an outline structure of a head unit according to a third embodiment.

FIG. 14 illustrates an outline structure of a head unit 200*c* according to a third embodiment. In the head unit 200 according to the first embodiment, the volume changing portions 220 are arranged in the horizontal direction and the pressure chambers 210 are arranged in the horizontal direction. In contrast, in the head unit 200*c* according to the third embodiment, the volume changing portions 220 are arranged in the gravity direction and the pressure chambers 210 are arranged in the gravity direction. According to the third embodiment, 10 combinations of the nozzles 211, the respective pressure chambers 210, and the respective volume changing portions 220 are provided. According to the third embodiment, the volume changing portions 220 are arranged in six rows extending in the horizontal direction of FIG. 14.

According to the third embodiment, as the blocking portion 230, a plurality of separate blocking portions 232 are provided. The separate blocking portions 232 are independently movable and are each able to block one or more inlets 212. According to the present embodiment, two separate blocking portions 232 are provided. Each of the separate blocking portions 232 is provided at a corresponding one of the ends in the horizontal direction of FIG. 14 and blocks five inlets 212. Since each of the separate blocking portions 232 can be independently controlled by the controller 40, the control can be performed in more flexible manner.

Figure 15:
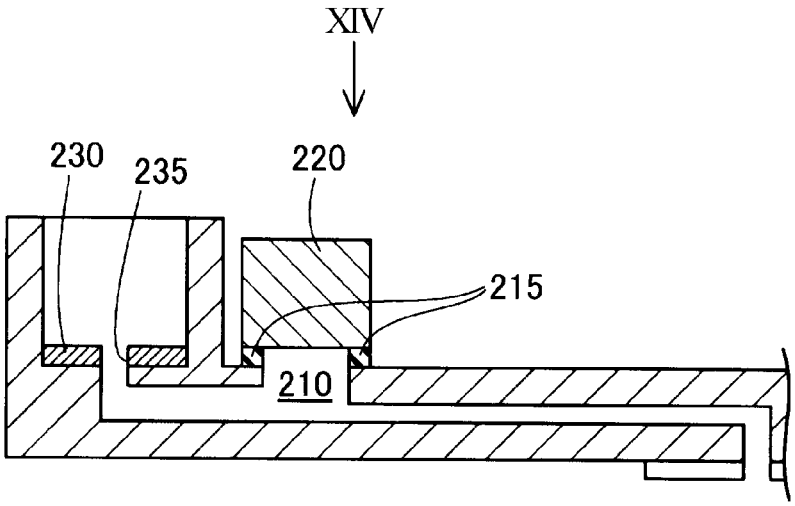
FIG. 15 is a sectional view taken along line XV-XV of FIG. 14.
Figure 16:
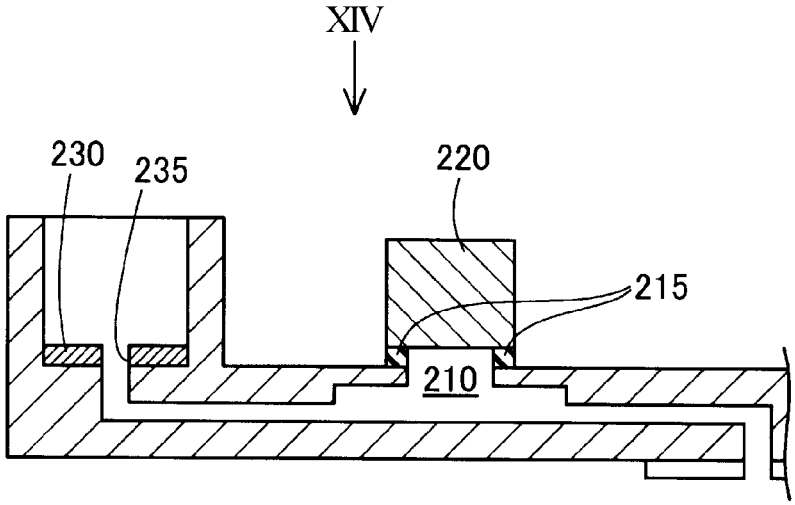
FIG. 16 is a sectional view taken along line XVI-XVI of FIG. 14.
Figure 17:
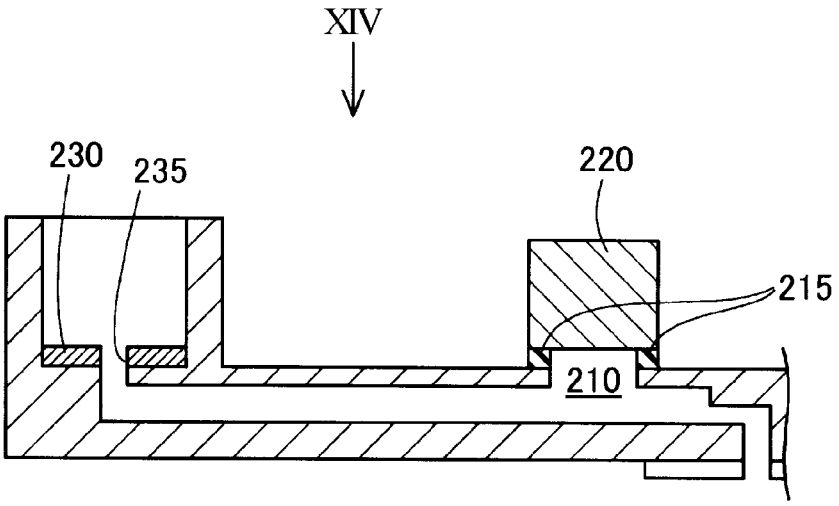
FIG. 17 is a sectional view taken along line XVII-XVII of FIG. 14.

FIGS. 15, 16, and 17 are sectional views illustrating the respective pressure chambers 210 and regions near the pressure chambers 210. FIG. 15 is a sectional view taken along line XV-XV of FIG. 14. FIG. 16 is a sectional view taken along line XVI-XVI of FIG. 14. FIG. 17 is a sectional view taken along line XVII-XVII of FIG. 14. FIG. 14 is a sectional view taken along line XIV-XIV of FIGS. 15, 16, and 17.

Figure 18:
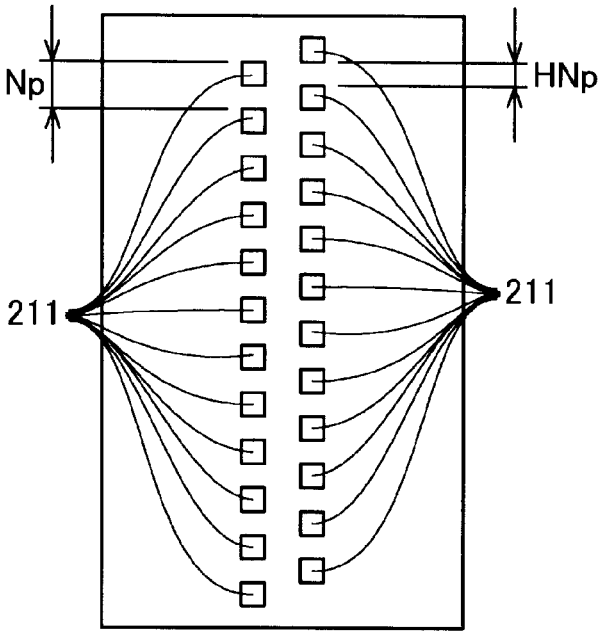
FIG. 18 is a schematic view of the nozzles when seen from below in the gravity direction.

FIG. 18 is a schematic view of the nozzles 211 when seen from below in the gravity direction. The nozzles 211 corresponding to the respective volume changing portions 220 vertically arranged in the gravity direction (vertical direction of FIG. 12) in FIG. 12 are, as illustrated in FIG. 13, arranged with the pitch Np in the vertical direction of FIG. 13. Furthermore, the nozzles 211 corresponding to the respective volume changing portions 220 arranged side by side in the horizontal direction (horizontal direction of FIG. 12) of FIG. 12 are arranged in the horizontal direction of FIG. 13 as illustrated in FIG. 13. These nozzles 211 are arranged with the pitch HNp in the vertical direction of FIG. 13.

Also according to the third embodiment, the volume changing portions 220 are arranged in a plurality of rows spaced from one another. In the direction along these rows, rows of the plurality of volume changing portions 220 are staggered from one another. Thus, the density of the nozzles 211 can be increased.

D. Other Embodiments

According to any of the above-described embodiments, in each of the combinations of the pressure chambers 210 and the nozzles 211, the pressure chamber 210 together with the nozzles 211 has an equal volume in the state in which the inlets 212 are blocked by the blocking portion 230. However, the invention is not limited to this. For example, in each of the combinations of the pressure chambers 210 and the nozzles 211, a flow resistance from the inlet 212 to the nozzle 211 may be the same. In this way, the differences in discharge speed and discharge amount between the nozzles 211 can be suppressed. The flow resistance can be calculated by, for example, the following method.

In a portion where the channel has an elongated box shape, when the length of the channel in the flowing direction is L, the length on the long side of the section of the channel is w, the length on the short side of the section of the channel is h, and the viscosity coefficient is η, a flow resistance R is given by the following expression 1:

$$R=12\eta L/wh^3 \quad 1.$$

Also, in a portion where the channel has a cylindrical shape, when the length of the channel in the flowing direction is L, the radius of the channel is r, and the viscosity coefficient is η, a flow resistance R is given by the following expression 2:

$$R=8\eta L/\pi L^4 \quad 2.$$

Instead of the piezoactuator used in the above-described embodiments, the actuator may be any one of various types such as a solenoid, a magnetostrictive element, and the like may be used. Furthermore, in order to increase the amount of extension, the actuator may include an extension displacement mechanism.

According to the above-described embodiments, the pressure chambers 210 are connected to the supply channel 30. Furthermore, a discharge channel and a circulation channel may be provided. The liquid is discharged from the pressure chambers 210 through the discharge channel. The circulation channel resupplies the liquid discharged from the discharge channel to the supply channel. In this way, the liquid can be efficiently used.

Although the blocking portion 230 is provided according to the above-described embodiments, the blocking portion 230 is not necessarily provided.

The invention can be used not only for a liquid discharge device that discharges ink but also for any liquid discharge device that discharges other liquid than ink. For example, the invention can be used for a variety of liquid discharge devices as follows.

1. Image recording devices such as facsimile machines.
2. Colorant discharge devices used for the manufacture of color filters for image displays such as liquid crystal displays.
3. Electrode material discharge devices used for forming electrodes of displays such as organic electroluminescence (EL) displays and field emission displays (FEDs).
4. Liquid discharge devices that discharge liquids including biological organic matter used for the manufacture of biochips.
5. Sample discharge devices as precision pipets.
6. Lubricant discharge devices.
7. Resin liquid discharge devices.
8. Liquid discharge devices for pinpoint discharge of lubricant to precision mechanical instruments such as clocks and cameras.
9. Liquid discharge devices that discharge on substrates transparent resin liquids such as ultra-violet curable resin liquids for forming micro-semispherical lenses (optical lenses) used for, for example, optical communication elements.
10. Liquid discharge devices that discharge acidic or alkaline etchants for etching, for example, substrates.

11. Liquid discharge devices that include a liquid discharge head discharging a small amount of any other droplets.

The term "droplet" refers to a state of a liquid discharged from the liquid discharge device including a granular shape, a tear-shape, or a shape with a filiform trail. Herein, it is sufficient that "liquid" be a material that can be consumed by the liquid discharge device. For example, it is sufficient that the "liquid" be a material that is a substance in the liquid phase. Thus, the "liquid" may be a material of a high viscosity or a low viscosity in a liquid state, a sol, gel-water, or another type of an inorganic solvent, an organic solvent, or a solution, or a material in a liquid state such as liquid resin or liquid metal (molten metal). Furthermore, "liquid" refers not only to a liquid as a state of a substance but also to particles of a functional material containing a solid substance such as a pigment or metal particles dissolved in, dispersed in, or mixed with a solvent. Typical examples of the liquid include ink, liquid crystal, and so forth. Here, the ink refers to a usual water-based or oil-based ink, or any of various liquid compositions such as gel ink and hot-melt ink.

The invention is not limited to the above-described embodiments and can be realized in various structures without departing from the gist of the invention. For example, technical features of the embodiments corresponding to the technical features of the form described in the Summary can be appropriately replaced or combined so as to partly or entirely address the above-described problem or obtain some or the entirety of the above-described effects. Furthermore, technical features that are not described as essential in this specification can be appropriately deleted.

The entire disclosure of Japanese Patent Application No.: 2017-164204, filed Aug. 29, 2017 is expressly incorporated by reference herein.

What is claimed is:

1. A liquid discharge device comprising:

a plurality of volume changing portions that are in combination with a plurality of pressure chambers which communicate with nozzles for discharging a liquid and which have inlets through which the liquid flows into the plurality of pressure chambers and that change volumes of the plurality of pressure chambers so as to apply pressure to insides of the plurality of pressure chambers, thereby discharging the liquid from the nozzles; and at least one blocking portion that blocks communication at the inlets, the at least one blocking portion being configured to slide transversely to a direction in which the plurality of volume changing portions change volumes of the plurality of pressure chambers, wherein the plurality of volume changing portions are arranged in a plurality of rows spaced from one another, wherein, in a direction along the plurality of rows, the plurality of rows of volume changing portions are staggered from one another, and wherein the liquid is discharged from the nozzles by using the plurality of volume changing portions in a state in which the inlets are blocked by the at least one blocking portion.

2. The liquid discharge device according to claim 1, wherein the nozzles are arranged in a single row.

3. The liquid discharge device according to claim 1, wherein the at least one blocking portion includes a plurality of separate blocking portions that are independently movable, and wherein the plurality of blocking portions are each able to block one or more inlets.

4. The liquid discharge device according to claim 1, wherein each of the pressure chambers together with a corresponding one of the nozzles that is in communication with the pressure chamber has an equal volume in the state in which the inlets are blocked by the at least one blocking portion.

5. The liquid discharge device according to claim 1, wherein a flow resistance from each of the inlets to a corresponding one of the nozzles that is in communication with a corresponding one of the pressure chamber having the inlet is equal.

6. The liquid discharge device according to claim 1, wherein a volume changing portion of the plurality of volume changing portions associated with one pressure chamber of the plurality of pressure chambers overlaps a nozzle that is connected to another pressure chamber adjacent to the one pressure chamber.

* * * * *